US009603443B2

(12) United States Patent
Boyke et al.

(10) Patent No.: US 9,603,443 B2
(45) Date of Patent: Mar. 28, 2017

(54) ORAL CARE SYSTEM

(71) Applicant: Colgate-Palmolive Company, Piscataway, NJ (US)

(72) Inventors: Christine Boyke, Somerset, NJ (US); Donghui Wu, Bridgewater, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 14/434,293

(22) PCT Filed: Oct. 18, 2012

(86) PCT No.: PCT/US2012/060773

§ 371 (c)(1),
(2) Date: Apr. 8, 2015

(87) PCT Pub. No.: WO2014/062184

PCT Pub. Date: Apr. 24, 2014

(65) Prior Publication Data

US 2015/0272312 A1 Oct. 1, 2015

(51) Int. Cl.
*A46B 11/00* (2006.01)
*A46B 5/00* (2006.01)

(52) U.S. Cl.
CPC ..... *A46B 11/001* (2013.01); *A46B 5/0041* (2013.01); *A46B 11/00* (2013.01);
(Continued)

(58) Field of Classification Search
CPC . A41C 19/02; A45C 11/008; A45C 2011/007; A45D 44/18; A46B 11/00;
(Continued)

(56) References Cited

U.S. PATENT DOCUMENTS 1,304,769 A * 5/1919 Hendrickson ..... A46B 5/0033 132/311
2,247,003 A * 6/1941 Smith ..... A45D 44/18 132/311

(Continued)

FOREIGN PATENT DOCUMENTS

AU 2941777 4/1979
CN 102665483 9/2012

(Continued)

OTHER PUBLICATIONS

International Search Report & Written Opinion for International Application No. PCT/US2012/060768 issued on Sep. 10, 2013.

(Continued)

*Primary Examiner* — Todd E Manahan
*Assistant Examiner* — Jennifer Gill

(57) ABSTRACT

An oral care system including a handle and a toothbrush member and dispenser rotatably coupled to the handle. In one aspect, the toothbrush member is rotatably coupled to the handle for rotation between: (1) a first state in which the toothbrush member is positioned within the cavity, and (2) a second state in which the toothbrush member extends from the distal end of the handle. The first dispenser comprises a first store of oral care material and is rotatably coupled to the handle for rotation between: (1) a first state in which the first dispenser is positioned within the cavity, and (2) a second state in which the first dispenser extends from the distal end of the handle. In another aspect, the invention can be an oral care system comprising first and second dispensers and a toothbrush member rotatably coupled to a handle.

5 Claims, 10 Drawing Sheets

(52) U.S. Cl.
CPC ..... *A46B 11/002* (2013.01); *A46B 11/0065* (2013.01); *A46B 5/0016* (2013.01); *A46B 2200/1066* (2013.01)

(58) Field of Classification Search
CPC . A46B 11/001; A46B 11/002; A46B 11/0065; A46B 15/0095; A46B 2200/1066; A46B 5/0033; A46B 5/0041; A46B 5/0095; A46B 7/023; A46B 7/026; A61C 19/02; B65D 85/20
See application file for complete search history.

(56) References Cited

U.S. PATENT DOCUMENTS

| | | | | |
|---|---|---|---|---|
| 2,284,217 | A | 5/1942 | Lieberthal | |
| 2,399,660 | A | 5/1946 | Boulicault | |
| 2,438,641 | A | 3/1948 | Loehr | |
| 2,845,645 | A | 8/1958 | Milton | |
| 2,968,827 | A | 1/1961 | Lawsine | |
| 3,734,118 | A | 5/1973 | Howard | |
| 3,769,991 | A * | 11/1973 | McGrath | A61Q 11/00 132/308 |
| 4,056,110 | A | 11/1977 | Landsman | |
| 4,228,925 | A | 10/1980 | Mendelovich | |
| 4,275,750 | A | 6/1981 | Clark | |
| 4,296,518 | A | 10/1981 | Furrier et al. | |
| 4,344,535 | A * | 8/1982 | Cagnazzi | A45D 44/18 132/308 |
| 4,543,679 | A | 10/1985 | Rosofsky et al. | |
| 4,576,190 | A | 3/1986 | Youssef | |
| 4,759,381 | A | 7/1988 | Cesari | |
| 4,865,481 | A | 9/1989 | Scales | |
| 4,866,809 | A | 9/1989 | Pelletier | |
| 4,879,781 | A | 11/1989 | Desimone | |
| 5,010,906 | A | 4/1991 | Preciutti | |
| 5,028,158 | A | 7/1991 | Fey | |
| 5,244,298 | A | 9/1993 | Greenhouse | |
| 5,339,483 | A | 8/1994 | Byun | |
| 5,382,107 | A | 1/1995 | Nian | |
| 5,403,105 | A | 4/1995 | Jameson | |
| 5,415,187 | A | 5/1995 | Heneveld | |
| 5,423,427 | A * | 6/1995 | Brown | A46B 5/0095 132/311 |
| 5,425,591 | A | 6/1995 | Contreras et al. | |
| 5,608,940 | A | 3/1997 | Panyon, Jr. | |
| 5,611,687 | A | 3/1997 | Wagner | |
| 5,735,298 | A | 4/1998 | Mayne et al. | |
| 5,862,817 | A | 1/1999 | Lee | |
| 5,911,532 | A | 6/1999 | Evancic | |
| 5,970,990 | A | 10/1999 | Dunton et al. | |
| 5,980,145 | A | 11/1999 | Griffith | |
| 6,056,469 | A | 5/2000 | Algorri | |
| 6,099,315 | A | 8/2000 | Markowitz | |
| 6,220,773 | B1 | 4/2001 | Wiegner et al. | |
| 6,227,209 | B1 | 5/2001 | Kim et al. | |
| 6,290,417 | B1 | 9/2001 | Kaminski | |
| 6,325,076 | B1 | 12/2001 | Ramirez | |
| 6,439,885 | B2 | 8/2002 | Antler | |
| 6,648,641 | B1 | 11/2003 | Viltro et al. | |
| 6,672,783 | B1 | 1/2004 | Licata et al. | |
| 6,895,976 | B2 | 5/2005 | Hetzler et al. | |
| 7,143,462 | B2 | 12/2006 | Hohlbein | |
| 7,237,974 | B2 | 7/2007 | Pfenniger et al. | |
| 7,264,471 | B2 | 9/2007 | Malcmacher et al. | |
| 7,677,827 | B1 | 3/2010 | Manukian | |
| 8,052,016 | B2 | 11/2011 | Wang | |
| 2001/0045369 | A1 | 11/2001 | Pearlman et al. | |
| 2002/0073496 | A1 | 6/2002 | Kim | |
| 2003/0012594 | A1 | 1/2003 | Andersen | |
| 2004/0020508 | A1 | 2/2004 | Earl | |
| 2006/0067783 | A1 | 3/2006 | Tsaur | |
| 2006/0260635 | A1 | 11/2006 | Dabney | |
| 2006/0269351 | A1 | 11/2006 | McAfee | |
| 2008/0118300 | A1 | 5/2008 | Burrowes | |
| 2009/0288262 | A1 | 11/2009 | Hall | |
| 2010/0284726 | A1 | 11/2010 | Ottaviani et al. | |
| 2011/0308030 | A1 | 12/2011 | Jimenez et al. | |
| 2011/0314623 | A1 | 12/2011 | Jimenez et al. | |
| 2012/0257920 | A1 | 10/2012 | Jimenez et al. | |

FOREIGN PATENT DOCUMENTS

| | | |
|---|---|---|
| EP | 0308549 | 3/1989 |
| EP | 0385815 | 9/1990 |
| FR | 2752150 | 2/1998 |
| GB | 792448 | 3/1958 |
| GB | 1190280 | 4/1970 |
| GB | 2307674 | 6/1997 |
| GB | 2393642 | 4/2004 |
| WO | WO 96/01579 | 1/1996 |
| WO | WO 02/47992 | 6/2002 |
| WO | WO 2005/065373 | 7/2005 |
| WO | WO 2005/110024 | 11/2005 |
| WO | WO 2009/075586 | 6/2009 |
| WO | WO 2010/132590 | 11/2010 |

OTHER PUBLICATIONS

International Search Report & Written Opinion for International Application No. PCT/US2012/060773 issued on Sep. 20, 2013.
International Search Report & Written Opinion for International Application No. PCT/US2012/060776 issued on Sep. 19, 2013.

* cited by examiner

ORAL CARE SYSTEM

CROSS-REFERENCE TO RELATED PATENT APPLICATIONS

This application is a U.S. national stage application under 35 U.S.C. §371 of PCT Application No. PCT/US2012/060773, filed Oct. 18, 2012, the entirety of which is incorporated herein by reference.

FIELD OF THE INVENTION

The present invention relates generally to an oral care system, and specifically to an oral care system including a toothbrush member and at least one dispenser that are coupled to a housing.

BACKGROUND OF THE INVENTION

Oral care products or agents are applied in different ways. For example, a common technique used for tooth whitening products is to cast an impression of a person's teeth and provide a tray of the shape of this impression. While tray-based systems are suitable, many people do not use them due to the fact that they tend to be uncomfortable and/or awkward. Moreover, in order to use a whitening tray, a user must keep the tray and the required components at hand. This not only requires extra storage space in already cramped bathroom cabinets but also requires that the user remember to use the whitening system. Furthermore, these tray-based systems are not conveniently portable for transport and/or travel.

In addition to difficulties in applying some oral care products, storage is sometimes cumbersome and inconvenient for the user. The oral care product must typically be stored separately from oral care tooth cleaning implements such as a toothbrush since the oral care product package and toothbrush heretofore are generally treated as separate and distinct parts of an oral care regimen. A more portable, compact and convenient way to store oral care products, and to dispense and apply those oral care products to oral surfaces is desired.

BRIEF SUMMARY OF THE INVENTION

Embodiments of the present invention provide an efficient, compact, and portable oral care system that combines an oral care implement such as a toothbrush with an oral care product or agent dispenser in a highly portable housing. Advantageously, such embodiments are especially suited for easy transport and/or travel.

In one embodiment, the invention can be an oral care system comprising: a handle comprising a cavity and extending along a longitudinal axis from a proximal end to a distal end; a toothbrush member comprising a first end rotatably coupled to the handle for rotation between: (1) a first state in which the toothbrush member is positioned within the cavity; and (2) a second state in which the toothbrush member extends from the distal end of the handle; and a first dispenser comprising a first store of oral care material and a first end rotatably coupled to the handle for rotation between: (I) a first state in which the first dispenser is positioned within the cavity; and (2) a second state in which the first dispenser extends from the distal end of the handle.

In another embodiment, the invention can be an oral care system comprising: a handle comprising a cavity and extending along a longitudinal axis from a proximal end to a distal end; a toothbrush member extending from the distal end of the handle; a first dispenser comprising a first store of oral care material and a first end rotatably coupled to the handle for rotation between: (1) a first state in which the first dispenser is positioned within the cavity; and (2) a second state in which the first dispenser extends from the proximal end of the handle; and a second dispenser comprising a second store of oral care material and a first end rotatably coupled to the handle for rotation between: (1) a first state in which the second dispenser is positioned within the cavity; and (2) a second state in which the second dispenser extends from the proximal end of the handle.

In yet another embodiment, the invention can be an oral care system comprising: a handle comprising a cavity; a toothbrush member coupled to the handle; a first dispenser comprising a first store of oral care material rotatably coupled to the handle for rotation between: (1) a first state in which the first dispenser is positioned within the cavity; and (2) a second state in which the first dispenser extends from the cavity of the handle; and a second dispenser comprising a second store of oral care material rotatably coupled to the handle for rotation between: (I) a first state in which the second dispenser is positioned within the cavity; and (2) a second state in which the second dispenser extends from the cavity of the handle.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1B:
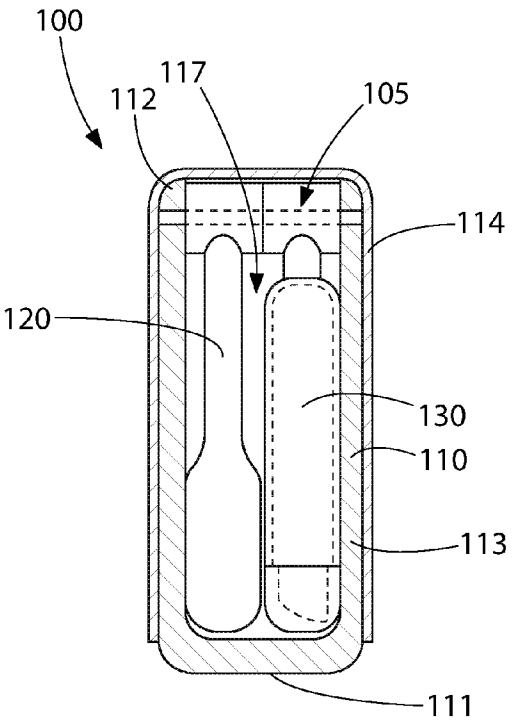
FIG. 1B is a schematic cross-sectional view taken along line IB-IB of FIG. 1A.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Preferred embodiments of the present invention will now be described with respect to one or more possible oral care or treatment systems. Embodiments of the oral care system include a dispenser that may include, without limitation, one or more of the following oral care materials: tooth whitening, antibacterial, enamel protection, anti-sensitivity, anti-inflammatory, anti-attachment, fluoride, tartar control/protection, flavorant, sensate, colorant and others. However, other embodiments of the present invention may be used to store and dispense any suitable type of oral care material and the invention is expressly not limited to any particular oral care system or oral care material alone. Furthermore, some embodiments of the oral care system include a first dispenser and a second dispenser, each of which may include any one of the oral care materials noted above. A more detailed, although still non-exhaustive, listing of possible oral care materials that may be stored in the dispenser(s) of the present invention and utilized with the oral care system will be provided below.

Figure 1A:
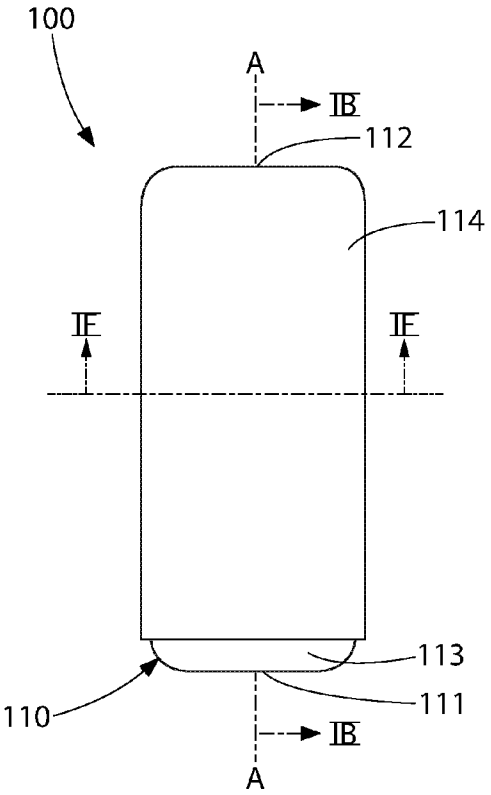
FIG. 1A is a front view of an oral care system according to one embodiment of the present invention including a handle having a body portion and a lid.

Referring to FIGS. 1A and 1B, an oral care system 100 is illustrated according to one embodiment of the present invention. The oral care system 100 is a compact readily portable self-contained user-friendly system that comprises all of the necessary components and chemistries for a user to perform a desired oral care treatment routine. As will be described in greater detail below, the oral care system 100 in one exemplary embodiment generally takes the form of a handle 110 having a cavity 117 that retains a toothbrush member 120 and a first dispenser 130 therein. The toothbrush member 120 and the first dispenser 130 are rotatably coupled to the handle 110. The oral care system 100 is portable for travel, easy to use, and reduces the amount of required storage space. Furthermore, since the toothbrush member 120 and the first dispenser 130 are housed together, the user is less likely to misplace the first dispenser 130 and will be more inclined to maintain the oral treatment routine with the first dispenser 130 since brushing will remind the user to apply the contents of the first dispenser 130.

In the exemplified embodiment, the toothbrush member 120 is a manual toothbrush that is typically used to brush a user's teeth. However, the toothbrush member 120 can be any other type of oral care implement in other embodiments, such as for example without limitation, a powered toothbrush, a tongue scraper, a gum and soft tissue cleanser, a water pick, an interdental device, a tooth polisher, a specially designed ansate implement having tooth engaging elements specially designed to increase the effect of the active agent in the dispenser on the teeth or any other type of implement that is commonly used for oral care. Thus, it is to be understood that the inventive concepts discussed herein can be applied to any type of oral care implement unless a specific type of oral care implement is specified in the claims.

The oral care system 100 comprises the handle 110 extending along a longitudinal axis A-A from a proximal end 111 to a distal end 112. The proximal end 111 of the handle 110 forms a closed bottom end of the handle 110. The distal end 112 of the handle 10 forms an open top end 105 of the handle 110 through which the toothbrush member 120 and/or the first dispenser 130 can extend. Thus, as will be discussed in more detail below, the toothbrush member 120 and the first dispenser 130 can rotate relative to the handle 110 so as to exit the cavity 117 and extend from the distal end 112 of the handle 110 and through the open top end 105 of the handle 110.

In the exemplified embedment, the handle 110 generally comprises a body portion 113 and a lid 114. In exemplified embodiment, the lid 114 is removably coupled to the body portion 113 of the handle 110. Specifically, the lid 114 is removably coupled to the body portion 113 of the handle 110 by any means known in the art, including an interference fit, threaded engagement, indent/detent, fasteners or the like. The means of coupling the lid 114 to the body portion 113 of the handle 110 is not to be limiting of the present invention unless so specified in the claims. The lid 114 provides protection to the toothbrush member 120 and the first dispenser 130, which are stored within the cavity 117 of the handle 110 by preventing access into the cavity 117 of the handle 110 when the lid 114 is coupled to the body portion 113 of the handle 110.

Figure 1E:
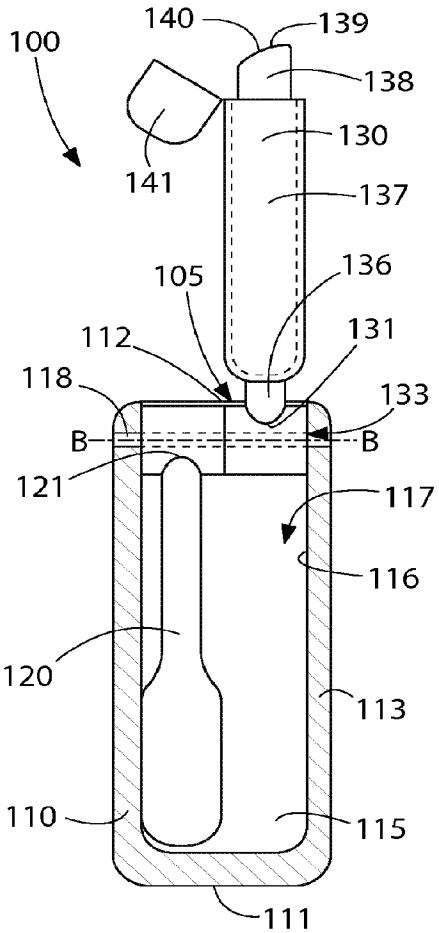
FIG. 1E is the cross-sectional view of FIG. 1B, wherein the lid is removed and a first dispenser extends from the handle.
Figure 1D:
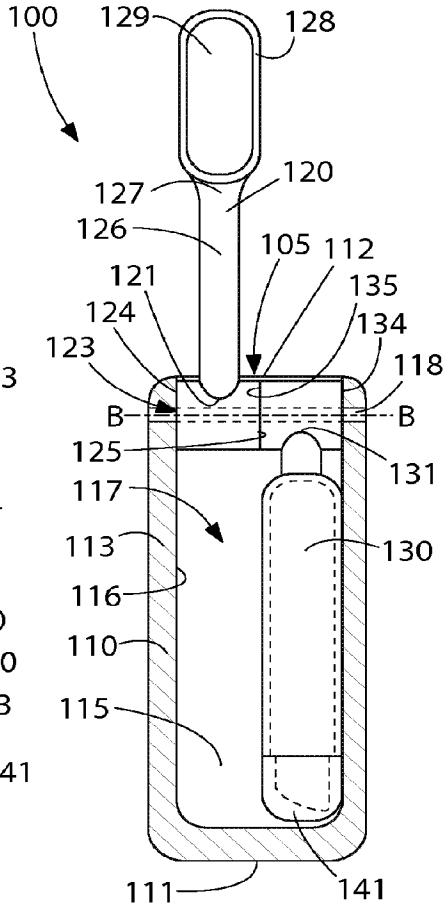
FIG. 1D is the cross-sectional view of FIG. 1B, wherein the lid is removed and a toothbrush member extends from the handle.
Figure 1C:
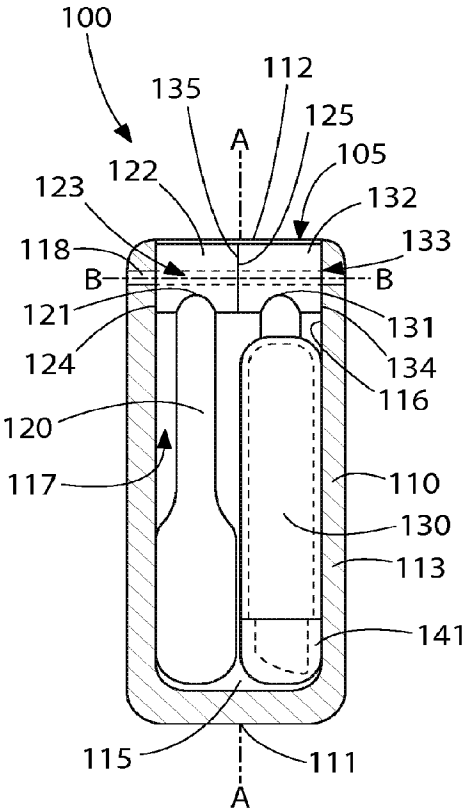
FIG. 1C is the cross-sectional view of FIG. 1B, wherein the lid is removed.

Referring to FIGS. 1A-1E concurrently, the oral care system 100 will be further described. FIGS. 1C-1E illustrate cross-sectional views of the oral care system 100 with the lid 114 removed from the body portion 113 of the handle 110. When the lid 114 is removed from the body portion 113 of the handle 110, the handle 110 is in an open state in which an access opening 115 that provides access into the cavity 117 is exposed. The handle 110 has an inner surface 116 that defines the cavity 117. The access opening 115 provides a passageway from the area external to the body portion 113 of the handle 110 into the cavity 117. When the lid 114 is coupled to the body portion 113 of the handle 110 as illustrated in FIG. 1A, the handle 110 is in a closed state in which the lid 114 covers the access opening 115 and encloses the cavity 117. Thus, in the closed state any components that are positioned within the cavity 117 are protected against damage by being fully covered by the combination of the body portion 113 and the lid 114. However, when the lid 114 is removed from the body portion 113 of the handle 110 as illustrated in FIGS. 1B-ID, the handle 110 is in an open state in which the access opening 115 is exposed so that a passageway between the cavity 117 and the area external to the body portion 113 is created.

Figure 1F:
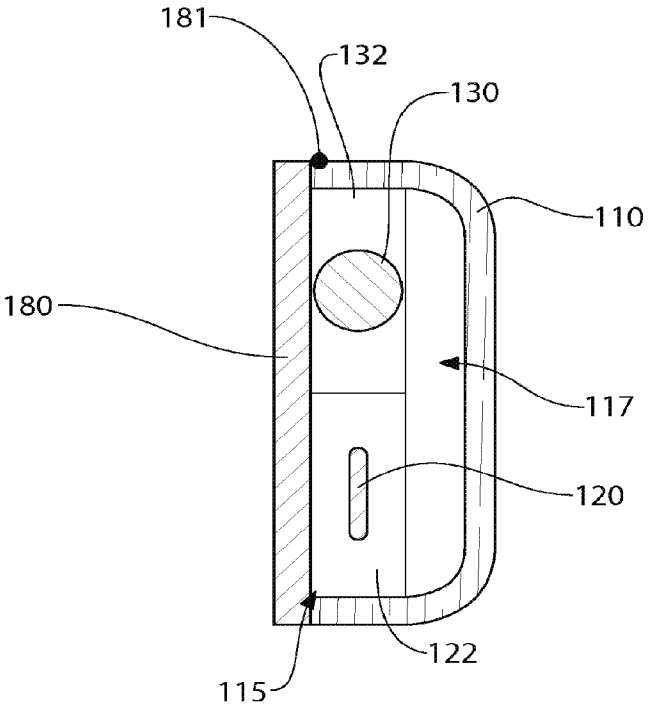
FIG. 1F is a schematic transverse cross-sectional view taken along line IF-IF of FIG. 1A illustrating an alternative embodiment of the lid coupled to the handle.

In the exemplified embodiment of FIGS. 1A and 1B, the lid 114 is illustrated as covering and circumferentially surrounding the entire body portion 113 of the handle 110. However, the invention is not to be so limited in all embodiments. The lid 114 only needs to cover the access opening 115 in the closed state and enable the access opening 115 to be exposed in the open state. Thus, referring briefly to FIG. IF, a schematic transverse cross-section of the oral care system 100 is provided to illustrate one possible alternative embodiment of a lid 180. In FIG. 1F, the lid 180 forms a panel that covers the access opening 115. The lid 180 is hingedly coupled to the handle 110 by a hinge 181. Thus, the lid 180 remains coupled to the handle 110 in both the open and closed states due to the hinged connection between the lid 180 and the handle 110. Furthermore, in another alternative embodiment, the lid can be a panel that slidably covers the access opening 115 by fitting the lid panel within slots on an inner surface 116 of the body portion 113 of the handle 110.

Referring now solely to FIGS. 1C-1E, the oral care system 100 will be further described. The oral care system 100 comprises the toothbrush member 120 and the first dispenser 130. The toothbrush member 120 comprises a first end 121 that is rotatably coupled to the handle 110. Furthermore, the first dispenser 130 has a first end 131 that is rotatably coupled to the handle 110. The first dispenser 130 comprises a first store of oral care material stored therein within an internal cavity thereof. In FIG. 1C, the toothbrush member 120 is in a first state in which the toothbrush member 120 is positioned within the cavity 117 of the handle 110. Furthermore, in FIG. 1C the first dispenser 130 is in a first state in which the first dispenser 130 is positioned within the cavity 117 of the handle 110. Each of the toothbrush member 120 and the first dispenser 130 are able to rotate from the first states to a second state by passing the toothbrush member 120 and the first dispenser 130 through the access opening 115 when the lid 114 is removed from the body portion 113 of the handle 110.

FIG. 1D illustrates the oral care system 100 whereby the first dispenser 130 remains in the first state positioned within the cavity 117 while the toothbrush member 120 is rotated into the second state in which the toothbrush member 120 extends from the distal end 112 of the handle 110 through the open top end 105 of the handle 110. Furthermore, FIG. 1E illustrates the oral care system 100 whereby the toothbrush member 120 is in the first state positioned within the cavity 117 while the first dispenser 130 is rotated into the second state in which the first dispenser 130 extends from the distal end 112 of the handle 110 through the open top end 105 of the handle 110. Furthermore, it should be appreciated that both of the toothbrush member 120 and the first dispenser 130 can be rotated into the second state at the same time such that each of the toothbrush member 120 and the first dispenser 130 are extending from the distal end 112 of the handle 110 through the open top end 105 of the handle 110 at the same time. However, it is desirable to only have one of the toothbrush member 120 and the first dispenser 130 in the second position at a time to prevent the other one of the toothbrush member 120 and the first dispenser 130 from interfering with its use.

Although not illustrated, each of the toothbrush member 120 and the first dispenser 130 may include a hook or other grasping element to better enable a user to rotate the toothbrush member 120 and the first dispenser 130 between the first and second states. Furthermore, in certain embodiments a locking mechanism that is biased into a locking position when one of the toothbrush member 120 or the first dispenser 130 is extending from the handle 110 can be incorporated within the oral care system 100. In such embodiments, the locking mechanism ensures that the toothbrush member 120 and the first dispenser 130 are locked into place when they are in the second state. For example, a user may be required to depress a button to unlock the toothbrush member 120 and the first dispenser 130 in order to rotate the toothbrush member 120 and the first dispenser 130 from the second state back into the first state. This will provide a more sturdy oral care system 100 so that when the toothbrush member 120 is being used to brush a user's teeth or when the first dispenser 130 is being used to dispense an oral care material, the toothbrush member 120 and the first dispenser 130 will remain fixed in the second position. A similar locking mechanism may be used to lock the toothbrush member 120 and the first dispenser 130 into the first state to prevent accidental rotation of the toothbrush member 120 and the first dispenser 130 from the first state into the second state.

In the exemplified embodiment, the first end 121 of the toothbrush member 120 is coupled to a rotatable body 122 having an aperture 123 formed therethrough. Similarly, the first end 131 of the first dispenser 130 is coupled to a rotatable body 132 having an aperture 133 formed therethrough. The aperture 123 of the rotatable body 122 of the toothbrush member 120 is aligned with the aperture 133 of the rotatable body 132 of the first dispenser 130. A pin 118 is coupled to the body portion 113 of the handle 110 and extends through the apertures 123, 133 of the rotatable bodies 122, 132 of the toothbrush member 120 and the first dispenser 130. Thus, the rotatable bodies 122, 132 form a hub that surrounds the pin 118 (or shaft) for facilitating rotation of the toothbrush member 120 and the first dispenser 130.

The pin 118 is an elongated cylindrical shaped component that has a longitudinal axis that forms a rotational axis B-B for each of the toothbrush member 120 and the first dispenser 130. In the exemplified embodiment, the rotational axis B-B is substantially perpendicular to the longitudinal axis A-A of the handle 110. In alternating between the first and second states, each of the toothbrush member 120 and the first dispenser 130 rotates about the rotational axis B-B. Thus, in the exemplified embodiment, each of the toothbrush member 120 and the first dispenser 130 rotates about the same rotational axis B-B.

In other embodiments, the toothbrush member 120 and the first dispenser 130 may rotate about different rotational axes. For example, in one embodiment the toothbrush member 120 may rotate about a first rotational axis that is located at one end (such as the proximal end 111) of the handle 110 while the first dispenser rotates about a second rotational axis that is located at an opposite end (such as the distal end 112) of the handle 110. In one such embodiment, the first dispenser 130 and the toothbrush member 120 may nest in a side-by-side relationship within the handle 110 when both the first dispenser 130 and the toothbrush member 120 are in the first state. In the their second states, the first dispenser 130 will extend from the distal end 112 while the toothbrush member 120 will extend from the proximal end 11. In one such embodiment, the first and second rotational axes may be substantially parallel to one another.

In the exemplified embodiment, each of the toothbrush member 120 and the first dispenser 130 is capable of 180° of rotation about the rotational axis B-B. Furthermore, each of the toothbrush member 120 and the first dispenser 130 is only capable of rotation in a first direction when rotating from the first state positioned within the cavity 117 to the second state extending from the handle 110 and rotation in a second direction when rotating from the second state extending from the handle 110 back to the first state positioned within the cavity 117. This is due to only having an access opening 115 on one surface of the handle 110. The other surfaces of the handle 110 are enclosed so that rotation of the toothbrush member 120 and the first dispenser 130 is only possible through and in the direction towards the access opening 115. Of course, the invention is not to be so limited in all embodiments and in certain other embodiments additional access openings can be provided to enable a full 360° rotation of the toothbrush member 120 and the first dispenser 130 as desired.

The toothbrush member 120 and the first dispenser 130 are axially adjacent to one another along the rotational axis B-B. More specifically, in the exemplified embodiment the rotatable body 122 of the toothbrush member 120 has a first side 124 and an opposing second side 125. Similarly, the rotatable body 132 of the first dispenser 130 has a first side 134 and an opposing second side 135. The first side 124 of the rotatable body 122 of the toothbrush member 120 is adjacent to the inner surface 116 of the body portion 113 of the handle 110. The first side 134 of the rotatable body 132 of the first dispenser 130 is adjacent to the inner surface 116 of the body portion 113 of the handle 110. In the exemplified embodiment, the first sides 124, 134 of the rotatable bodies 122, 132 of each of the toothbrush member 120 and the first dispenser 130 are in surface contact with the inner surface 116 of the body portion 113 of the handle 110. However, the invention is not to be so limited in all embodiments and in certain other embodiments a gap may be formed between the first sides 124, 134 of the rotatable bodies 122, 132 and the inner surface 116 of the body portion 113 of the handle 110. Furthermore, the second side 125 of the rotatable body 122 of the toothbrush member 120 is adjacent to the second side 135 of the rotatable body 132 of the first dispenser 130. In the exemplified embodiment, the second sides 125, 135 of the rotatable bodies 122, 132 are in surface contact with one another. However, the invention is not to be so limited in all embodiments.

In the exemplified embodiment, due to their positioning adjacent one another and adjacent to the inner surface 116 of the body portion 113 of the handle 110, the toothbrush member 120 and the first dispenser 130 are prohibited from translating along the rotational axis B-B. Of course, as noted above small gaps may be formed between the toothbrush member 120 and the first dispenser 130 and between each of the toothbrush member 120 and the inner surface 116 of the body portion 113 of the handle 110. In such embodiments, small amounts of movement along the rotational axis B-B may be possible.

The toothbrush member 120 and the first dispenser 130 are separately rotationally coupled to the pin 118. Thus, each of the toothbrush member 120 and the first dispenser 130 are rotatable about the rotational axis B-B independent of one another. This enables a user to only position one of the toothbrush member 120 or the first dispenser 130 into the second state for use of that component while the other one of the toothbrush member 120 or the first dispenser 130 remains in the first state positioned within the cavity 117 of the handle 110. When both of the toothbrush member 120 and the first dispenser 130 are in the second state, it is difficult to use either of the toothbrush member 120 (to clean teeth) or the first dispenser 130 (to apply an agent or oral care material to a user's teeth). Thus, by leaving one of the toothbrush member 120 or the first dispenser 130 in the first state within the cavity 117 while the other one of the toothbrush member 120 and the first dispenser 130 extends from the handle 110, that device can be properly used to clean a users teeth or apply an oral care material to the user's teeth without interference from the other device.

The toothbrush member 120 comprises a narrowed neck portion 126 extending from the first end 121 of the toothbrush member 120 to a distal end 127. The narrowed neck portion 126 is an elongated portion of the toothbrush member 120 that enables tooth cleaning elements (described below) to be spaced from the handle 110 when the toothbrush member 120 is in the second state so that the toothbrush member 120 can be used to clean a user's teeth in a comfortable manner. Furthermore, the toothbrush member 120 comprises a widened head portion 128 (widened relative to the neck portion 126) coupled to and extending from the distal end 127 of the neck portion 126. In the exemplified embodiment, the widened head portion 128 is oval in shape. However, the invention is not to be so limited in all embodiments and the widened head portion 128 can take on other shapes as desired. A plurality of tooth cleaning elements 129 extend outwardly from the head portion 128. The tooth cleaning elements 129 are generically illustrated in FIG. 1D.

The exact structure, pattern, orientation and material of the tooth cleaning elements 129 is not to be limiting of the present invention unless so specified in the claims. As used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 129 of the present invention can be connected to the widened head portion 128 of the toothbrush member 120 in any manner known in the art. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

In certain embodiments, the widened head portion 128 of the toothbrush member 120 may also include a soft tissue cleanser coupled to or positioned on a surface opposite the surface from which the tooth cleaning elements 129 extend. An example of a suitable soft tissue cleanser that may be used with the present invention is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the widened head portion 128 of the toothbrush member 120 may not include any soft tissue cleanser.

The first dispenser 130 has a neck portion 136 that extends from the rotatable body 132 and connects a main body 137 of the first dispenser 130 to the rotatable body 132. The main body 137 of the first dispenser 130 forms a hollow cavity for storing a first store of oral care material therein. Furthermore, the first dispenser 130 has an applicator 138 extending from the main body 137 for applying the first store of the oral care material onto a user's teeth or other oral surfaces. The applicator 138 forms a second end 139 of the first dispenser 130 that is opposite the first end 131 of the first dispenser 130. A dispensing orifice 140 is formed into the second end 139 of the first dispenser 130. In certain embodiments the first dispenser 130, including the structural details and means for dispensing oral care material, may be similar to that disclosed in U.S. patent application Ser. No. 13/518,424, filed on Jun. 22, 2012, the entirety of which is incorporated herein by reference.

In certain embodiments, the applicator 138 may be formed of an elastomeric material to provide comfort when applying the oral care material directly onto a user's teeth and/or oral surfaces from the first dispenser 130. Specifically, when dispensing the oral care material directly onto a tooth, the applicator 138 can be made to contact the tooth directly to ensure that the oral care material is adequately and sufficiently applied onto the tooth surface. Forming the applicator 138 out of an elastomeric material makes this direct dispensing process more comfortable for a user. However, the invention is not to be so limited and in certain other embodiments the applicator 138 may be formed of other materials, including bristles, a porous or sponge material, or a fibrillated material. Furthermore, in still other embodiments the applicator 138 may be omitted and the dispensing orifice 140 can be formed directly into the first dispenser 130 for dispensing the oral care material contained therein.

The main body 137 of the first dispenser 130 is an elongated structure having an inner surface that defines a hollow interior cavity for storing the oral care material therein. In certain embodiments, the first dispenser 130 may be refillable so that a user can refill the oral care material into the first dispenser 130 after depletion thereof. However, in certain other embodiments upon depletion of the oral care material within the first dispenser 130, the entire oral care system 100 will be replaced. Thus, the amount of the oral care material may be indicative of the life-cycle of the tooth cleaning elements 129 (i.e., the oral care material may last for three months when used regularly, which is the time period recommended for replacement of a toothbrush).

A user can apply the first store of oral care material by squeezing, compressing or otherwise forcing the first store of oral care material from the first dispenser 130 and out of the dispensing orifice 140 in the second end 139 of the first dispenser 130. In other embodiments, the oral care system 100 may include a threaded screw coupled to an elevator mechanism for forcing the oral care material from the first dispenser 130 out through the dispensing orifice 140. Of course, any other mechanisms that assist with dispensing, such as mechanical, electrical, or electromechanical pumps and the like, can be used in other embodiments.

In the exemplified embodiment, a cap 141 is detachably coupled to the first dispenser 130 to enclose the dispensing orifice 140. The cap 141 can be coupled to the first dispenser 130 so as to cover the applicator 138 and the second end 139 of the first dispenser 130 (including the dispensing orifice 140). Thus, the cap 141 can prevent accidental dispensing of the oral care material from the dispensing orifice 140 of the first dispenser 130 from occurring. The cap 141 also prevents the first store of oral care material from drying up inside of the first dispenser 130 by sealing the first store of oral care material within the cavity of the first dispenser 130. In certain embodiments, the cap 140 may include a sealing member that protrudes into the dispensing orifice 140 to perform the seal. When it is desired to dispense the first store of oral care material from the first dispenser 130, the cap 141 is first removed so that the dispensing orifice 140 is exposed.

In certain embodiments, the handle 110 is formed of a rigid plastic material, such as for example without limitation polymers and copolymers of ethylene, propylene, butadiene, vinyl compounds and polyesters such as polyethylene terephthalate. Furthermore, in certain embodiments the components of the toothbrush member 120 and the first dispenser 130 are also formed of one of the rigid plastic materials noted above. However, the invention is not to be so limited in all embodiments and in certain other embodiments the handle 110, the toothbrush member 120 and/or the first dispenser 130 can be formed of other materials. Furthermore, in some embodiments the handle 110 may be overmolded with a soft, resilient material, such as a thermoplastic elastomer, to provide comfort to a user when gripping the handle 110 during use of the oral care system 100 to clean and/or sanitize a user's oral cavity.

Figure 1G:
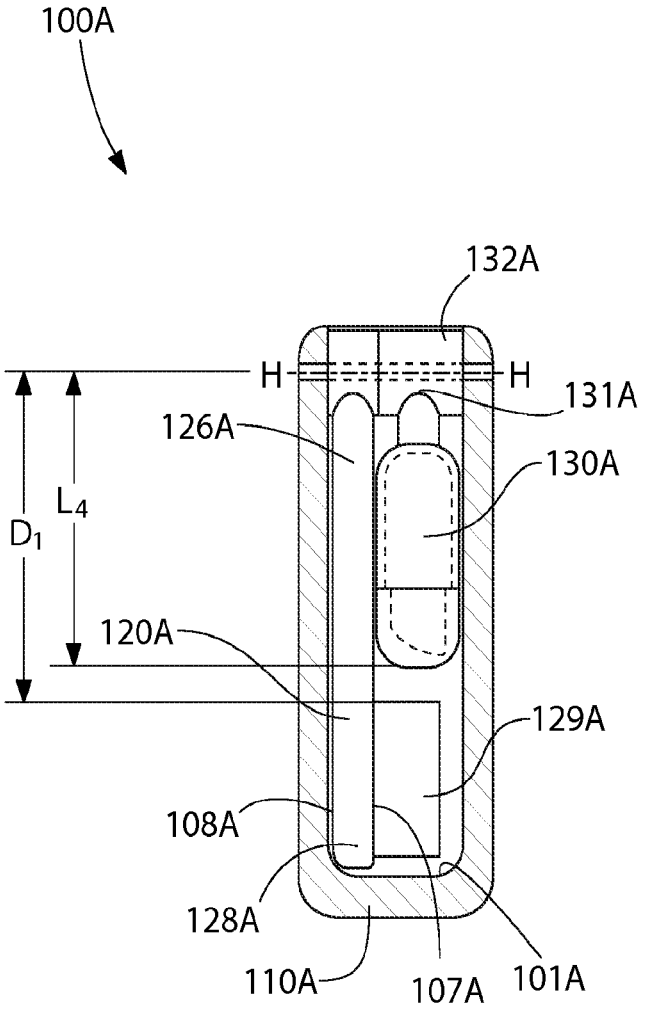
FIG. 1G is a schematic transverse cross-sectional view taken along line IB-IB of FIG. 1A according to another alternative embodiment of the present invention.

Referring now to FIG. 1G, an oral care system 100A is illustrated according to an alternate embodiment of the present invention. The oral care system 100A is identical to the oral care system 100 discussed above with the exception that the orientation of the toothbrush member 120A within the handle 110A is changed. Thus, in order to avoid redundancy, only those aspects of the oral care system 100A that differ from the oral care system 100 will be discussed below. It is to be understood that non-contradictory concepts described above for the oral care system 100 are (or can be) incorporated into the oral care system 100A. Moreover, for purposes of simplicity, corresponding elements of oral care system 100 and oral care system 100A will be given like reference numerals with the addition of the suffix "A."

In the oral care system 100A, the toothbrush member 120A comprises a head portion 128A and a neck portion 126A. The head portion 128A of the toothbrush member 120A comprises a front surface 107A and an opposing rear surface 108A. A plurality of tooth cleaning elements 129A extend outwardly from the front surface 107A of the head portion 128A of the toothbrush member 120A. The oral care system 100A further includes a dispenser 130A. Each of the dispenser 130A and the toothbrush member 120A is rotatable about a rotational axis H-H in a similar manner to that as has been discussed above with regard to the oral care system 100.

In the exemplified embodiment, the front surface 107A is substantially perpendicular to the rotational axis H-H. Furthermore, the dispenser 130A is located between the plurality of tooth cleaning elements 129A and the rotational axis H-H. More specifically, the dispenser 130A has a first end 103A connected to the rotational body 132A and an opposite second end 104A. The second end 104A of the dispenser 130A can be the end of an end cap 141A or it can be the end of the dispenser 130A that includes the applicator 138A and is the end of the dispenser 130A from which the store of oral care material is dispensed. The tooth cleaning elements 129A are located between the second end 104A of the dispenser 130A and a floor 101A of the handle 110A. Thus, the entirety of the dispenser 130A, including its extension from the first end 103A to the second end 104A, is located between the plurality of tooth cleaning elements 129A and the rotational axis A-A.

The dispenser 130A has a length $L_4$ from the rotational axis H-H to the second end 104A of the dispenser 130A. Furthermore, the tooth cleaning elements 129A are spaced a distance $D_1$ from the rotational axis H-H. The length L4 of the dispenser 130A is less than the distance D1 so that the entire dispenser 130A can fit within the distance D1 between the tooth cleaning elements 129A and the rotational axis H-H. This design enables a more compact handle 110A because the tooth cleaning elements 129A are facing the dispenser 130A, which saves space. Specifically the width of the handle 110A does not need to accommodate the combined with of the tooth cleaning elements 129A and the dispenser 130A, but rather just the combined width of the neck portion 126A of the toothbrush member 120A and the dispenser 130A.

Figure 2C:
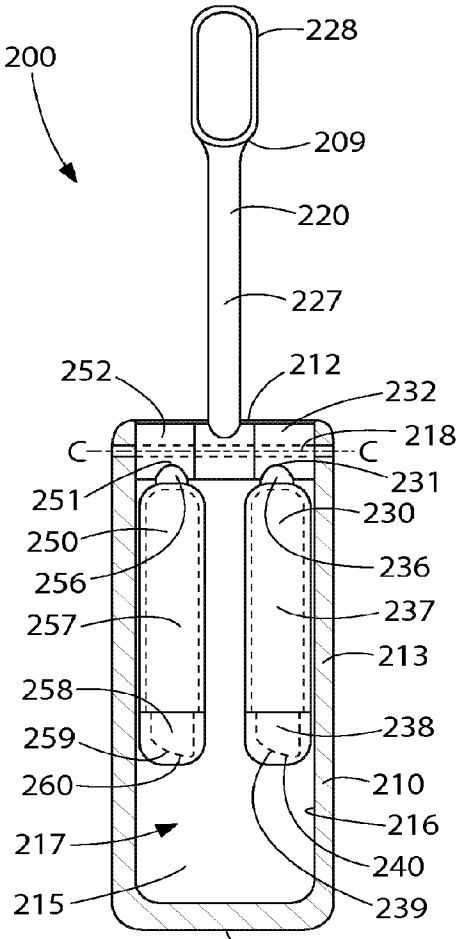
FIG. 2C is the schematic cross-sectional view of FIG. 2A, wherein the toothbrush member extends from the handle.
Figure 2B:
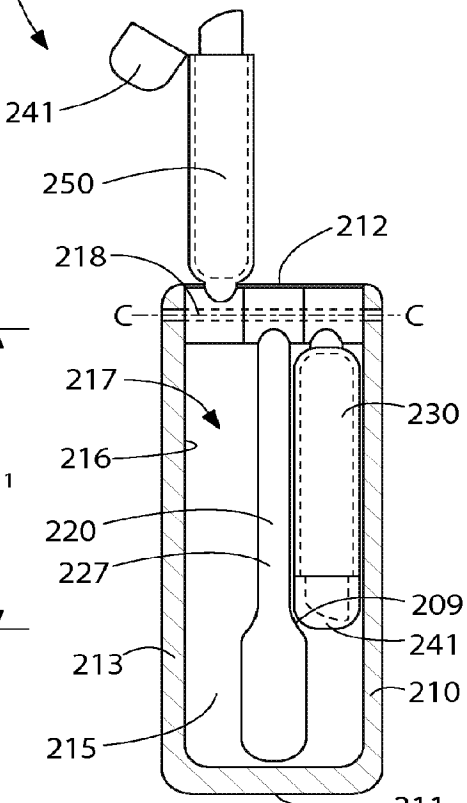
FIG. 2B is the schematic cross-sectional view of FIG. 2A, wherein a second dispenser extends from the handle.
Figure 2A:
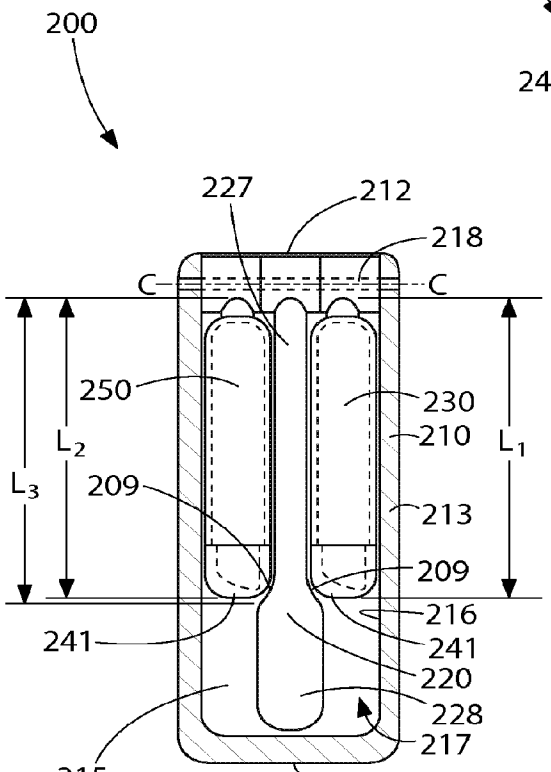
FIG. 2A is a schematic cross-sectional view taken along line IB-IB of FIG. 1A in accordance with a second embodiment of the present invention, wherein the lid is removed.

Referring to FIGS. 2A-2C, an alternate embodiment of an oral care system 200 is illustrated. The oral care system 200 is similar to the oral care system 100 described above. One difference between the oral care system 100 and the oral care system 200 is that the oral care system 200 comprises a toothbrush member 220, a first dispenser 230 and a second dispenser 250. Thus, similar features of the oral care system 200 relative to the oral care system 100 will be similarly numbered except that the 200-series of numbers will be used. It should be understood that for features of the oral care system 200 that are not described in detail below, the description of the similar feature in the oral care system 100 applies. Furthermore, certain features may be numbered in FIGS. 2A-2C without a corresponding description, and it should be understood that the description of the similar feature with a similar reference numeral (in the 100-series) should apply. Additionally, although the oral care system 200 is not illustrated with a lid, it should be understood that the lid 114 discussed above can be used with the oral care system 200.

The oral care system 200 comprises a handle 210 having an inner surface 216 that forms a cavity 217. A toothbrush member 220 having a narrowed neck portion 226 and a widened head portion 128 is rotatably coupled to the handle 210. A first dispenser 230 is rotatably coupled to the handle 210. Furthermore, in the oral care system 200 a second dispenser 250 is rotatably coupled to the handle 210. The rotatable coupling between the toothbrush member 220, the first dispenser 230 and the second dispenser 250 is similar to that discussed above with regard to the oral care system 100. Specifically, each of the toothbrush member 220, the first dispenser 230 and the second dispenser 250 is rotatable about a rotational axis C-C that extends along a pin 218.

The second dispenser 250 has a cavity that contains a second store of oral care material. Furthermore, the second dispenser 250 has a second end 251 that is rotatably coupled to the handle 210 for rotation between a first state in which the second dispenser 250 is positioned within the cavity 217 and a second state in which the second dispenser 250 extends from the distal end 212 of the handle 210. Thus, each of the toothbrush member 220, the first dispenser 230 and the second dispenser 250 is rotatable between a first state in which the component is positioned within the cavity 217 and a second state in which the component extends from the distal end 212 of the handle 210. Rotation from the first state to the second state is achieved by translating the component (i.e., the toothbrush member 220, the first dispenser 230 and/or the second dispenser 250) through the access opening 215 until the component exits the cavity 217 and extends from the distal end 212 of the handle 210. Each of the toothbrush member 220, the first dispenser 230 and the second dispenser 250 is separately and independently rotatable about the rotational axis C-C.

The first dispenser 230 has a neck portion 236 that extends from the rotatable body 232 and connects a main body 237 of the first dispenser 230 to the rotatable body 232. The main body 237 of the first dispenser 230 forms a hollow cavity for storing a first store of oral care material therein. Furthermore, the first dispenser 230 has an applicator 238 extending from the main body 237 for applying the first store of the oral care material onto a user's teeth or other oral surfaces. The applicator 238 forms a second end 239 of the first dispenser 230 that is opposite the first end 231 of the first dispenser 230. A dispensing orifice 240 is formed into the second end 239 of the first dispenser 230.

Similarly, the second dispenser 250 has a neck portion 256 that extends from the rotatable body 252 and connects a main body 257 of the second dispenser 250 to the rotatable body 252. The main body 257 of the second dispenser 250 forms a hollow cavity for storing a first store of oral care material therein. Furthermore, the second dispenser 250 has an applicator 258 extending from the main body 257 for applying the second store of the oral care material onto a user's teeth or other oral surfaces. The applicator 258 forms a second end 259 of the second dispenser 250 that is opposite the first end 251 of the second dispenser 250. A dispensing orifice 260 is formed into the second end 259 of the second dispenser 250.

In the exemplified embodiment, each of the toothbrush member 220, the first dispenser 230 and the second dispenser 250 is rotatable about the same rotational axis C-C. Furthermore, in the exemplified embodiment the toothbrush member 220 is located in between the first dispenser 230 and the second dispenser 250. However, the invention is not to be so limited in all embodiments and in certain other embodiments the relative locations between the toothbrush member 220 and the first and second dispensers 230, 250 can be other than that illustrated. Specifically, in one embodiment the first dispenser 230 can be located in between the second dispenser 250 and the toothbrush member 220.

Furthermore, in the exemplified embodiment, the first dispenser 230 has a first length $L_1$, the second dispenser 250 has a second length $L_2$ and the narrowed neck portion 227 of the toothbrush member 220 has a third length $L_3$. The third length $L_3$ of the toothbrush member 220 is greater than or equal to the first and second lengths $L_1$, $L_2$. In the exemplified embodiment, the third length $L_3$ of the toothbrush member 220 is greater than the first and second lengths $L_1$, $L_2$. Furthermore, in the exemplified embodiment the first and second lengths $L_1$, $L_2$ are substantially the same. The width of the toothbrush member 220 gradually increases in a transition region 209 between the narrowed neck portion 227 and the widened head portion 228. In the exemplified embodiment, the transition region 209 forms a part of the narrowed neck portion 227 of the toothbrush member 220. The transition region 209 forms a contoured shape that corresponds with the shape of the first and second dispensers 230, 250. Thus, the first and second dispensers 230, 250 are able to nest in the transition region 209 of the toothbrush member 220 to form a more compact handle 210. More specifically, in the exemplified embodiment the caps 241 of the first and second dispensers 230, 250 nest within the transition region 209 of the toothbrush member 220 due to corresponding shapes between the caps 241 and the transition region 209.

In the exemplified embodiment, when all of the components are positioned in the first state within the cavity 217, the first and second dispensers 230, 250 lie adjacent to the elongated narrowed neck portion 226 of the toothbrush member 220 and the widened head portion 227 of the toothbrush member 228 extends beyond the first and second dispensers 230, 250 towards the proximal end 211 of the handle 210. This arrangement of the toothbrush member 220 and the first and second dispensers 230, 250 enables the width and/or circumference of the handle 210 to be minimized because the cavity 217 does not need to accommodate, in an adjacent manner, the combination of the widths of the first and second dispenser 230, 250 and the widened head portion 228 of the toothbrush member 220.

In certain embodiments, the oral care material of the first store contained within the first dispenser 230 is different than the oral care material of the second store contained within the second dispenser 230. Of course, the invention is not to be so limited in all embodiments and in certain other embodiments the oral care material of the first and second stores can be the same.

It is to be understood that the inventive system can be utilized for a variety of intended oral care needs by filling the first and/or second dispensers 230, 250 with any oral care material, such as an oral care fluid that achieves a desired oral effect. In one embodiment, the oral care material of one or both of the stores is preferably free of (i.e., is not) toothpaste as the oral care material is intended to augment not supplant the brushing regimen. However, the invention is not to be so limited and in other embodiments the oral care material contained within at least one of the first or second dispensers 230, 250 can be or may include toothpaste. The oral care materials and/or its medium can be selected to complement a toothpaste formula, such as by coordinating flavors, colors, aesthetics, or active ingredients.

The oral care materials contained within the first and second dispensers 230, 250 may be a measured amount of a semi-viscous, yet flowable, aesthetically pleasing, pleasant tasting oral care composition that is dosed or metered through the dispensing orifice and delivered directly into a user's oral cavity or onto the tooth cleaning elements. The oral care material can either be a flowable liquid and/or a solid that is easily dispensed for consumer use. The flowable liquids may include, without limitation, pastes, gels, rinses, foams, scrubbers, solids, liquids and/or aerosols under compressed air.

The oral care materials can be used for a variety of oral care needs including but not limited to whitening, sensitivity, gum health, stain-removal, enamel strengthening, mouthrinse, breath spray, sanitizer solution for a toothbrush, and whole mouth care solutions. The oral care material may also include active ingredients typical of use in whole mouth oral care formulations. The oral care material may also contain sweeteners, sensates, particulate, and sensates capable of delivering unique benefits to the consumer.

The oral care material can be used as a stand-alone formulation. In some embodiments, the composition has the capability and potential of containing and delivering active ingredients, such as Fluoride, Arginine, Triclosan, or the like, while further providing potential cleaning, stain-removal, whitening of the teeth surface with the incorporation of chemical agents such as hydrogen peroxide, or polishing abrasives such as, for example, silica, dicalcium phosphate, precipitated calcium carbonate or the like. The composition also has the capability of delivering consumer perceivable visual signals via unique colorants, shapes, stripes, sparkles, extruded forms, etc, while further delivering consumer perceivable sensory signals delivered via unique flavors, sweeteners, sensates, or the like.

The oral care materials include materials that provide oral health benefits to a user upon contact with a user's oral cavity. In one embodiment, the oral care materials are fluidic materials. For example, in certain embodiments the oral care materials include a mouthwash solution that cleans the oral surfaces when applied thereto and provides the user with breath freshening benefits. In other embodiments, the oral care materials include a tooth cleaning solution, such as a dentifrice. Of course, the oral care materials are not to be in any way limiting of the present invention and may include fluids having active or inactive agents that deliver therapeutic, cosmetic, experiential and/or sensorial benefits to a consumer during a tooth, soft tissue, tongue or interdental cleaning regimen. Specifically, the oral care material can be an anti-sensitivity agent, fluoride, a tartar protection agent, an antibacterial agent, an oxidative or whitening agent, an enamel strengthening or repair agent, a tooth erosion preventing agent, a gum health active, a nutritional ingredient, a tartar control or anti-stain ingredient, an enzyme, a sensate ingredient, a flavor or flavor ingredient, a breath freshening ingredient, an oral malodor reducing agent, an anti-attachment agent or sealant, a diagnostic solution, an occluding agent, a dry mouth relief ingredient, a catalyst to enhance the activity of any of these agents, colorants or aesthetic ingredients, arginine bicarbonate, chlorohexidine, triclosan, CPC, zinc oxide and combinations thereof. As noted above, in certain embodiments the oral care materials or at least one of the oral care materials is free of a dentifrice as the oral care fluid is intended to supplement traditional brushing of the teeth rather than supplant it.

The formulation or oral care material in the dispensers can be used as a standalone formulation or if using a device with more than one dispenser, the formulations in the applicators can be used in a non-sequential or separate but sequential manner. For example, the non-sequential dispensers could be that one dispenser contains sanitizer spray for the toothbrush while the other contains plaque finding ingredients. In this case, the plaque finding ingredient would be used before brushing and the sanitizer spray in the other applicator would be used after brushing. The two dispensers could also be used in conjunction with one another. In this example, the whitening ingredient in one dispenser may need a sealant to be added in order to work over time. The first dispenser containing the whitening ingredient would then be applied to the first and the sealant in the second dispenser applied immediately afterward. These two formulas/benefits would not be compatible and/or would not be as effective if used in a single formulation.

Figure 2D:
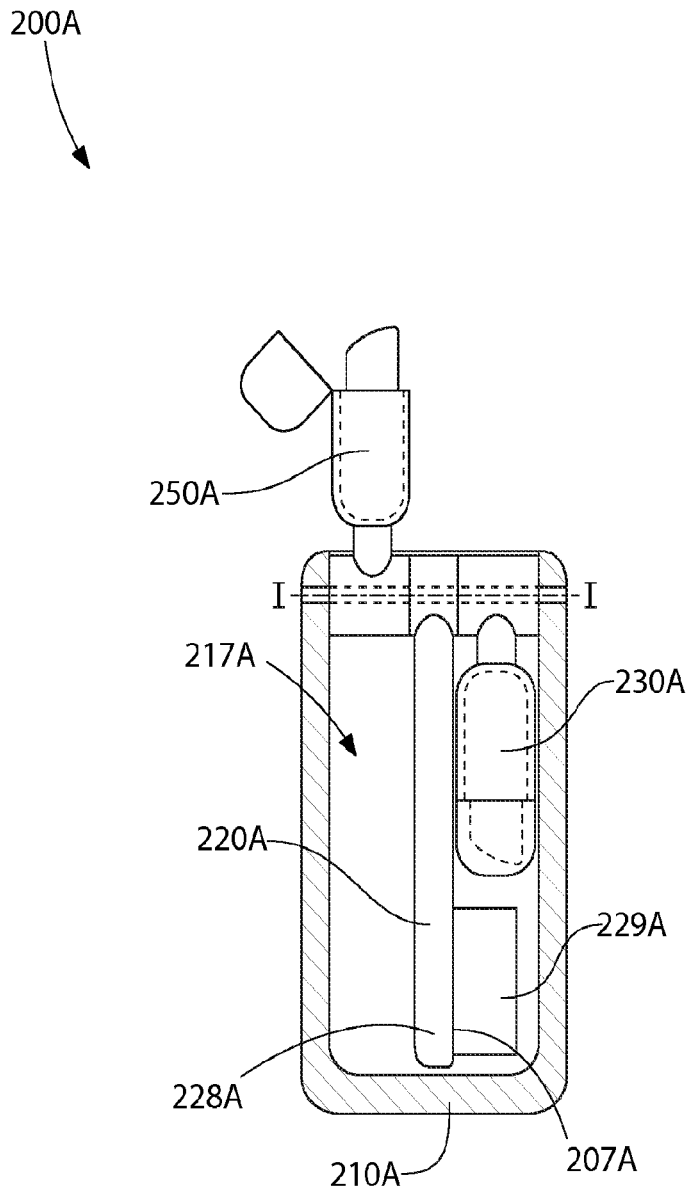
FIG. 2D is the schematic cross-sectional view of the oral care system of FIG. 2A according to an alternative embodiment of the present invention.

Referring now to FIG. 2D, an oral care system 200A is illustrated according to an alternate embodiment of the present invention. The oral care system 200A is identical to the oral care system 200 discussed above with the exception that the orientation of the toothbrush member 220A within the handle 210A is changed. Thus, in order to avoid redundancy, only those aspects of the oral care system 200A that differ from the oral care system 200 will be discussed below. It is to be understood that non-contradictory concepts described above for the oral care system 200 are (or can be) incorporated into the oral care system 200A. Moreover, for purposes of simplicity, corresponding elements of oral care system 200 and oral care system 200A will be given like reference numerals with the addition of the suffix "A."

The oral care system 200A includes a handle 110A having a cavity 217A. The oral care system 200A is similar to the oral care system 100A except that the oral care system 200A includes a first dispenser 230A and a second dispenser 250A. Specifically, a front surface 207A of a head 128A of the toothbrush member 220A from which tooth cleaning elements 229A extend is oriented substantially perpendicular to a rotational axis I-I of the toothbrush member 220A. Furthermore, the first dispenser 230A is positioned within the cavity 217A so that the entirety of the first dispenser 230A is located between the tooth cleaning elements 229A and the rotational axis I-I. The relative length of the second dispenser 250A is not limited by the tooth cleaning elements 229A because the second dispenser 250A is located adjacent a rear surface of the toothbrush member 220A. Thus, the second dispenser 250A can extend to the same length as the toothbrush member 220A. However, in other embodiments the second dispenser 250A can have the same length as the first dispenser 230A. Thus, each of the first and second dispensers 230A, 250A can be the same or different lengths.

Figure 3A:
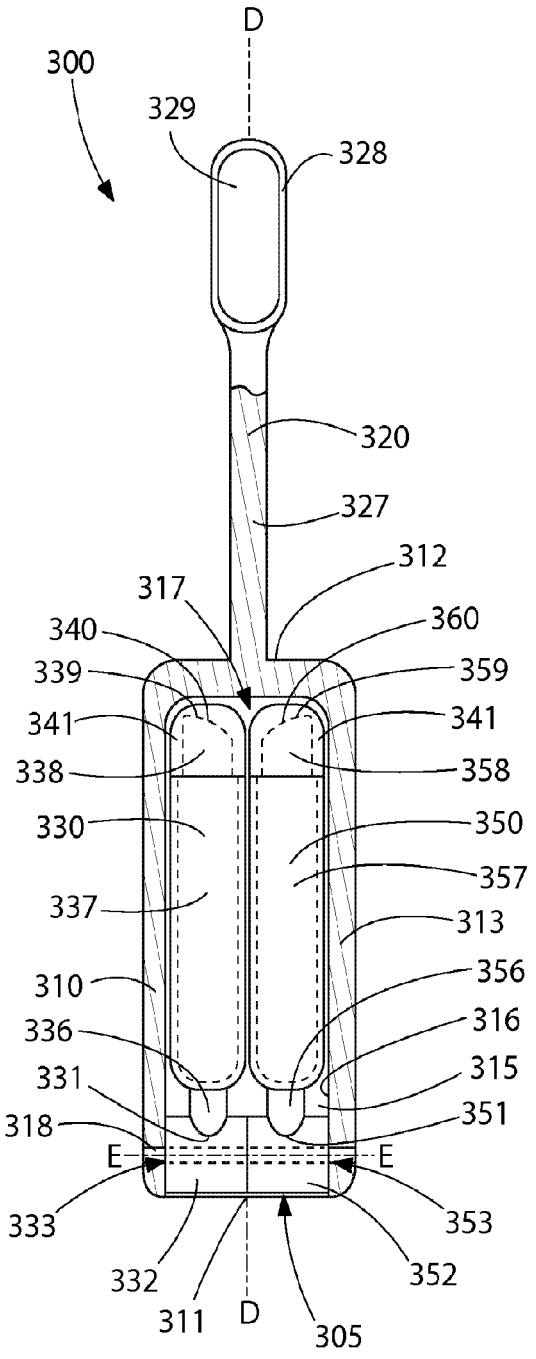
FIG. 3A is a schematic cutaway view of an oral care system in accordance with a third embodiment of the present invention, wherein a toothbrush member extends from a handle, and a first and second dispenser are positioned within a cavity of the handle.
Figure 3B:
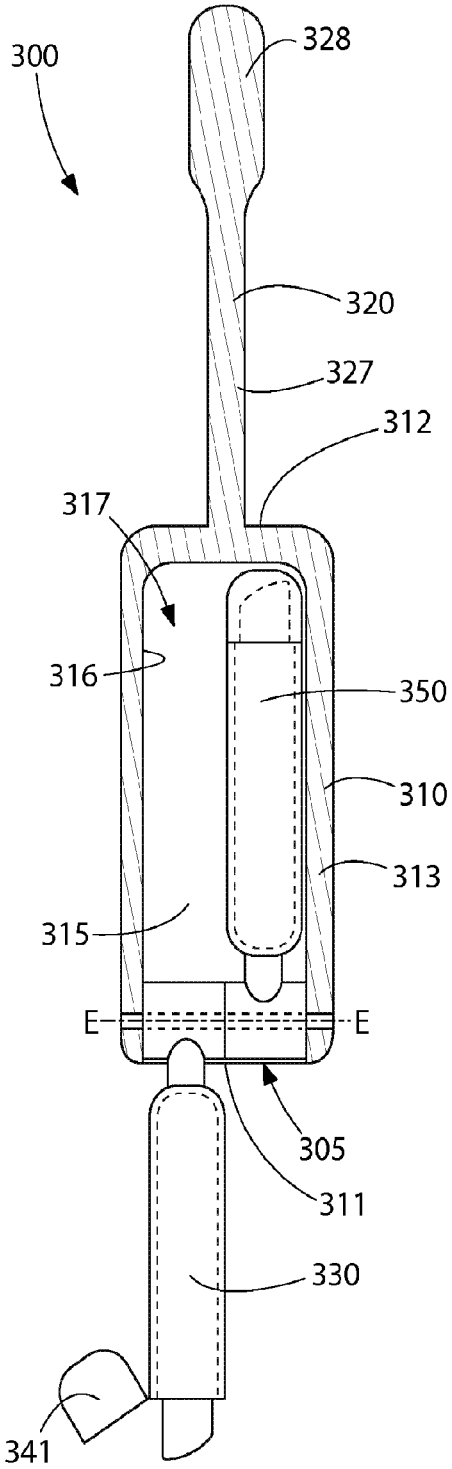
FIG. 3B is the schematic cutaway view of FIG. 3A, wherein the first dispenser extends from the handle.

Referring now to FIGS. 3A and 3B, an oral care system 300 will be described in accordance with an embodiment of the present invention. The oral care system 300 is similar to the oral care system 100 described above. Thus, similar features of the oral care system 300 relative to the oral care system 100 will be similarly numbered except that the 300-series of numbers will be used. It should be understood that for features of the oral care system 300 that are not described in detail below, the description of the similar feature in the oral care system 100 applies. Furthermore, certain features of the oral care system 300 will be numbered below but not described in detail with an understanding that the description of similar features from the oral care systems 100, 200 applies. Additionally, although the oral care system 300 is not illustrated with a lid, it should be understood that either of the lids 114, 180 discussed above can be used with the oral care system 300. However, as will be understood from the discussion below, the lids 114, 180 would cover the proximal end 311 of the handle 310.

The oral care system 300 comprises a handle 310 having an inner surface 316 that defines a cavity 317 and a first dispenser 330 and a second dispenser 350 rotatably coupled to the handle 310. Furthermore, an access opening 315 is formed into the handle 310 that provides a passageway from an external environment into the cavity 317. The handle 310 extends along a longitudinal axis D-D from a proximal end 311 to a distal end 312. The distal end 312 of the handle 310 forms a closed top end of the handle 310. Furthermore, the proximal end 311 of the handle 310 forms an open bottom end 305 of the handle 310 through which the first and second dispensers 330, 350 can extend as discussed in more detail below.

Although not illustrated, in certain embodiments the oral care system 300 further includes a lid that covers the proximal end 311 (i.e., the open bottom end 305) of the handle 310 and the access opening 315. The lid could be similar to the lid 114 discussed above with regard to FIGS. 1A and 1B or the lid 180 discussed above with regard to FIG. 1F. The lid is adjustable between an open state in which the access opening 315 through which the first and second dispensers 330, 350 can pass into and out of the cavity 317 is exposed, and a closed state in which the lid covers the access opening 315 and encloses the cavity 317. Thus, when in the closed state such a lid provides protection to the components stored within the cavity 317 and prevent the components from exiting the cavity 317 unless the lid is removed from the handle 310.

The oral care system 300 further comprises a toothbrush member 320 extending from the distal end 312 of the handle 310. In the exemplified embodiment, the toothbrush member 320 is integrally formed with the handle 310. Thus, the toothbrush member 320 is fixedly coupled to the handle 310. The toothbrush member 320 of the oral care system 300 is therefore not rotatably or otherwise movable relative to the handle 310. The handle 310 and the toothbrush member 320 may be formed together using a molding, milling, machining or other suitable process. Of course, the invention is not to be so limited and the handle 310 and the toothbrush member 320 can be separately formed and later coupled together by any suitable technique known in the art, including without limitation thermal or ultrasonic welding, a tight-fit assembly, a coupling sleeve, threaded engagement, adhesion, or fasteners.

The toothbrush member 320 comprises a narrowed neck portion 327 and a widened head portion 328. A plurality of tooth cleaning elements 329 extend outwardly from a surface of the widened head portion 328 of the toothbrush member 320. Thus, the toothbrush member 320 is similar to a manual toothbrush and can be used to brush a user's teeth and or gums during a toothbrushing regimen.

As discussed above, the oral care system 300 also comprises the first dispenser 330 and the second dispenser 350. Each of the first and second dispensers 330, 350 is rotatably coupled to the handle 310. The first dispenser 330 comprises a first store of oral care material and has a first end 331 that is rotatably coupled to the handle 310 for rotation between a first state (FIG. 3A) in which the first dispenser 330 is positioned within the cavity 317 and a second state (FIG. 3B) in which the first dispenser 330 extends from the proximal end 311 and through the open bottom end 305 of the handle 310. Similarly, the second dispenser 350 comprises a second store of oral care material and has a first end 351 that is rotatably coupled to the handle 310 for rotation between a first state (FIG. 3A) in which the second dispenser 350 is positioned within the cavity 317 and a second state (not illustrated) in which the second dispenser 350 extends from the proximal end 311 and through the open bottom end 305 of the handle 310.

The first end 331 of the first dispenser 330 is coupled to a rotatable body 332 that has an aperture 333 formed therethrough. The first end 351 of the second dispenser 350 is coupled to a rotatable body 352 that has an aperture 353 formed therethrough. A pin or shaft 318 extends through the apertures 333, 353 of the first and second rotatable bodies 332, 352. The pin 318 is fixed to the handle 310. Thus, each of the rotatable bodies 332, 352 of the first and second dispensers 330, 350 rotates around the pin 318. The pin 318 extends along an axis E-E, which is the rotational axis about which each of the first and second dispensers 330, 350 rotates. Thus, the first and second dispensers 330, 350 both rotate, independently of one another, about the some rotational axis E-E. The rotation of the first and second dispensers 330, 350 can be considered a Swiss Blade style mechanism.

The first dispenser 330 has a neck portion 336 that extends from the rotatable body 332 and connects a main body 337 of the first dispenser 330 to the rotatable body 332. The main body 337 of the first dispenser 330 forms a hollow cavity for storing a first store of oral care material therein. Furthermore, the first dispenser 330 has an applicator 338 extending from the main body 337 for applying the first store of the oral care material onto a user's teeth or other oral surfaces. The applicator 338 forms a second end 339 of the first dispenser 330 that is opposite the first end 331 of the first dispenser 330. A dispensing orifice 340 is formed into the second end 339 of the first dispenser 330.

Similarly, the second dispenser 350 has a neck portion 356 that extends from the rotatable body 352 and connects a main body 357 of the second dispenser 350 to the rotatable body 352. The main body 357 of the second dispenser 350 forms a hollow cavity for storing a second store of oral care material therein. Furthermore, the second dispenser 350 has an applicator 358 extending from the main body 357 for applying the second store of the oral care material onto a user's teeth or other oral surfaces. The applicator 358 forms a second end 359 of the second dispenser 350 that is opposite the first end 351 of the second dispenser 350. A dispensing orifice 360 is formed into the second end 359 of the second dispenser 350.

Each of the first and second dispensers 330, 350 has a cap 341 coupled thereto to prevent accidental dispensing of the oral care material and to prevent the oral care material stored in the dispensers from drying out. The rotatable bodies 332, 352 are positioned adjacent to one another such that the rotatable bodies 332, 352 can not move axially along the rotational axis E-E. Specifically, the rotatable bodies 332, 352 are adjacent to and in surface contact with one another and to the inner surface 316 of the handle 310 so that there is no space for axial movement of the rotatable bodies 332, 352 along the rotational axis E-E.

FIG. 3B illustrates the oral care system 300 with the first dispenser 330 in the second state extending from the proximal end 311 of the handle 310 and the second dispenser 350 retained within the cavity 317 of the handle 310. Both the first and second dispensers 330, 350 can be put into the second state at the same time if desired, such as when quick, successive application of the first and second stores of oral care material contained within the first and second dispensers 330, 350, respectively, is desirable. The first and second dispensers 330, 350 are alternated between the first and second states by rotating the first and second dispensers 330, 350 (and more specifically the rotatable bodies 332, 352 of the first and second dispensers 330, 350) about the rotational axis E-E. Upon such rotation of the first and second dispensers 330, 350, the first and second dispensers exit the cavity 317 through the access opening 315. The first and second dispensers 330, 350 are continued to be rotated until the first and/or second dispensers 330, 350 extend from the proximal end 311 of the handle 310. Thus, in this embodiment the toothbrush member 320 always extends from the distal end 312 of the handle 310 and the first and second dispensers 330, 350 can be made to extend from the proximal end 311 of the handle 310 opposite the distal end 312.

Figure 4C:
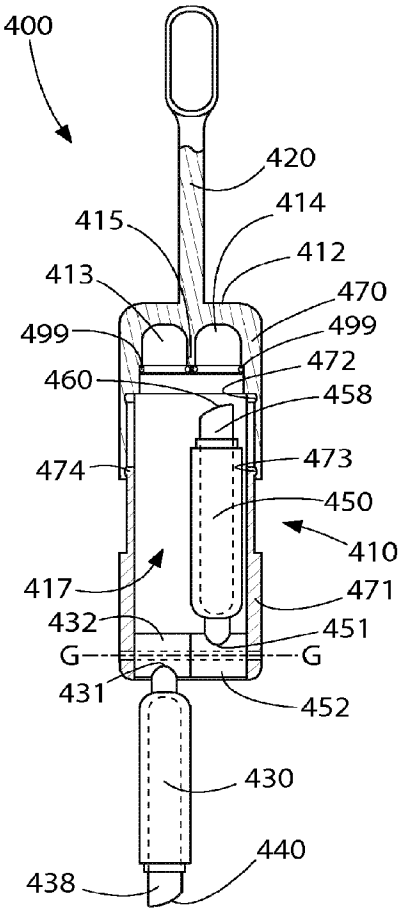
FIG. 4C is the schematic cutaway view of FIG. 4A, wherein the second portion of the handle is axially translated away from the first portion of the handle and the first dispenser extends from the handle.
Figure 4B:
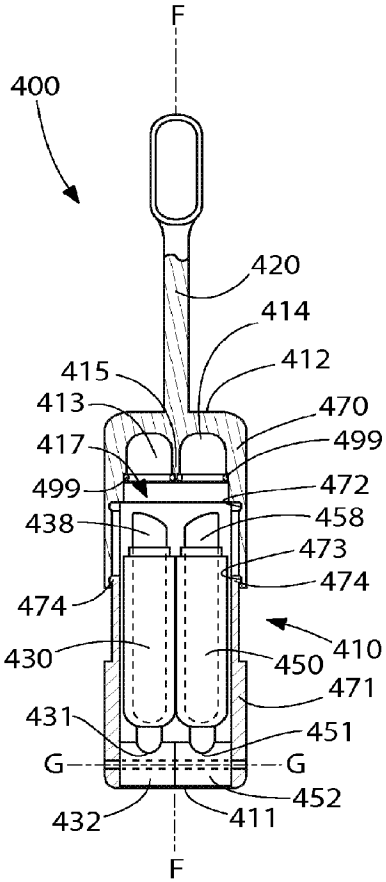
FIG. 4B is the schematic cutaway view of FIG. 4A, wherein a second portion of the handle is axially translated away from a first portion of the handle and first and second dispensers are positioned within cavity of the handle.
Figure 4A:
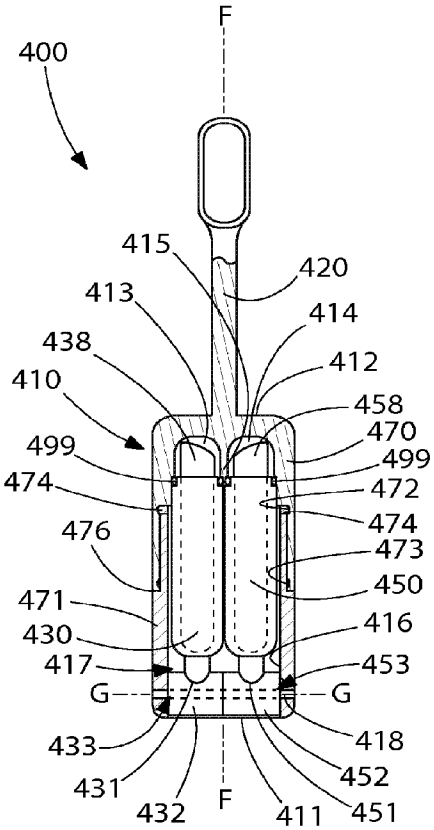
FIG. 4A is a schematic cutaway view of an oral care system in accordance with a fourth embodiment of the present invention.

Referring now to FIGS. 4A-4C, an oral care system 400 is illustrated in accordance with another embodiment of the present invention. The oral care system 400 is similar to the oral care system 300 described above. Thus, similar features of the oral care system 400 relative to the oral care system 300 will be similarly numbered except that the 400-series of numbers will be used. It should be understood that for features of the oral care system 400 that are not described in detail below, the description of the similar feature in the oral care system 300 applies.

The oral care system 400 comprises a handle 410 extending along a longitudinal axis F-F from a proximal end 411 to a distal end 412. Furthermore, a toothbrush member 420 is fixed to the handle 410 and extends outwardly from the distal end 412 of the handle 410. The toothbrush member 420 can be integrally formed with the handle 410 or the toothbrush member 420 can be separately formed and later connected to the handle 410. However, the toothbrush member 420 is non-movable relative to the handle 410.

The handle 410 has an inner surface 416 that defines a cavity 417. A first dispenser 430 and a second dispenser 450 are stored or positioned within the cavity 417. The first dispenser 430 and the second dispenser 450 are rotatably coupled to the handle 410 in the manner that has been discussed above with regard to the oral care systems 100, 200 and 300. Specifically, the first dispenser 430 has a first end 431 that is coupled to a rotatable body 432. The second dispenser 450 has a first end 451 that is coupled to a rotatable body 452. Each of the rotatable bodies 432, 452 has an aperture 433, 453 therethrough. A pin 418 that is coupled to the handle 410 extends through the apertures 433, 453 of the rotatable bodies 432, 452 of the first and second dispensers 430, 450. The pin 418 extends along a longitudinal axis G-G, and the longitudinal axis G-G forms a rotational axis about which the first and second dispensers 430, 450 rotates. Thus, each of the first and second dispensers 430, 450 is rotatable between a first state wherein the first and second dispensers 430, 450 are positioned within the cavity 417 and a second state in which the first and second dispensers 430, 450 extend from the proximal end 411 of the handle 410. As has been discussed above, each of the first and second dispensers 430, 450 are independently rotatable about the rotational axis G-G.

The main difference between the oral care system 400 and the oral care system 300 is that the handle 410 comprises a first portion 470 and a second portion 471. The second portion 471 is slidably coupled to the first portion 470, and the first and second dispensers 430, 450 are rotatably coupled to the second portion 471. In the exemplified embodiment the first portion 470 has a first annular channel 472 and a second annular channel 473. Furthermore, the second portion 471 has an annular protrusion 474. However, the invention is not to be so limited and in other embodiments the first and second annular channels can be formed into the second portion 471 and the annular protrusion can extend from the first portion 470. Furthermore, the channels and protrusions need not be annular in all embodiments and can merely be complementary shaped indents/detents or complementary shaped nubs/recesses.

The cavity 417 of the handle 410 comprises a first socket 413 and a second socket 414. The first socket 413 is sized and configured to retain an applicator 438 of the first dispenser 430 therein and the second socket 414 is sized and configured to retain an applicator 458 of the second dispenser 450 therein. A dispensing orifice 440, 460 is formed into the applicators 438, 458 of each of the first and second dispensers 430, 450. A separator wall 415 extends downwardly from a roof of the cavity 417 and separates the first and second sockets 413, 414 from one another. A tight seal is formed between the applicators 438, 458 and the inner surface 416 of the cavity 417 that defines the first and second sockets 413, 414 to prevent the first and second stores of oral care material contained within the first and second dispensers 430, 450, respectively, from drying out.

Furthermore, in the exemplified embodiment an O-ring 499 is provided at the edge of each of the openings into the first and second sockets 413, 414. The O-rings 499 can be any type of gasket or other seal. Thus, when the applicators 438, 458 of the dispensers 430, 450 are inserted into the first and second sockets 413, 414, the O-ring, gasket, or other seal 499 becomes compressed between the dispensers 430, 450 and the inner surface 416 of the cavity 417. As a result, a fluid-tight seal is formed that prevents the oral care material from drying out in the dispensers 430, 450. Furthermore, the oral care material is prevented from leaking out of the sockets 413, 414 and into the other portions of the cavity 417.

The second portion 471 of the handle 410 is slidable relative to the first portion 470 of the handle 410 between a first state and a second state. In the first state, which is illustrated in FIG. 4A, the annular protrusion 474 of the second portion 471 of the handle 410 nests within the first annular channel 472 of the first portion 470 of the handle 410. In this position, the applicators 438, 458 of the first and second dispensers 430, 450 are located within the first and second sockets 413, 414. In this first state, the first and second dispensers 430, 450 can not be rotated from the first states of the first and second dispensers 430, 450 wherein the first and second dispensers 430, 450 are located within the cavity 417 to the second states of the first and second dispensers 430, 450 wherein the first and second dispensers 430, 450 extend from the proximal end 411 of the handle 410. The first and second dispensers 430, 450 can be prevented from rotation in any manner including having a wall that extends axially along the length of the first and second sockets 413, 414 that blocks the first and second dispensers 430, 450 (and particularly the applicators 438, 458 of the first and second dispensers 430, 450) from being able to rotate freely about the rotational axis G-G.

As noted above, the second portion 471 of the handle 410 is slidable relative to the first portion 470 from a first state to a second state and vice versa. Specifically, by compressing or otherwise pressing inwardly onto the outer surface of the second portion 471 of the handle 410, the annular protrusion 474 can be disengaged from the first annular channel 472. Upon such disengagement, the second portion 471 of the handle 410 can be slid axially along the longitudinal axis F-F in a direction away from the toothbrush member 420 into the second state. In the second state, the annular protrusion 474 nests within the second annular channel 473. The second annular channel 473 forms a retaining feature that prevents the second portion 471 of the handle 410 from being completely disengaged from the first portion 470 of the handle 410. The second portion 471 of the handle 410 is slidable from the second state back to the first state by again compressing the second portion 471 of the handle 410 so that the annular protrusion 474 is disengaged from the second annular channel 473. Then, the second portion 471 of the handle 410 is slid axially towards the toothbrush member 420 until the annular protrusion 474 nests within the first annular channel 472.

When the second portion 471 is in the second state, the applicators 438, 458 of the first and second dispensers 430, 450 are removed from the first and second sockets 413, 414. Therefore, when the second portion 471 is in the second state, the first and second dispensers 430, 450 can be rotated from the first states of the first and second dispensers 430, 450 to the second states of the first and second dispensers 430, 450. More specifically, upon the second portion 471 being positioned into the second state illustrated in FIGS. 4B and 4C, the first and second dispensers 430, 450 can be rotated about the rotational axis G-G in much the same way as has been discussed herein above with regard to the other embodiments.

In certain embodiments, the first and second portions 470, 471 of the handle 410 form an interface 476 when the second portion 471 of the handle 410 is in the first state. In some embodiments, a seal is positioned at the interface 476 to prevent the ingress of liquids such as water and other debris from entering into the cavity 417 during storage of the oral care system 400. When the second portion 471 of the handle 410 is in the first state, the outer surfaces of the second portion 471 and the first portion 470 of the handle 410 form a flush, continuous outer surface of the handle 410. In certain embodiments it is possible to completely separate the second portion 471 of the handle 410 from the first portion 470 of the handle 410 so that the first and second dispensers 430, 450 can be used separately from the toothbrush member 420.

Figure 5A:
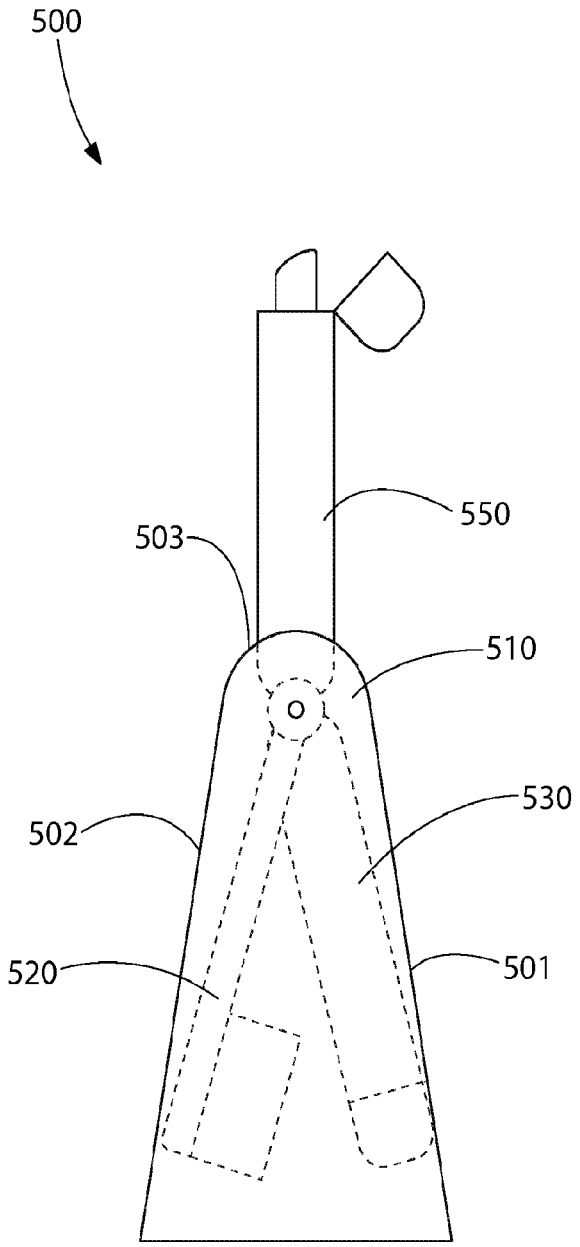
FIG. 5A is a schematic view of an oral care system according to a fifth embodiment of the present invention.
Figure 5B:
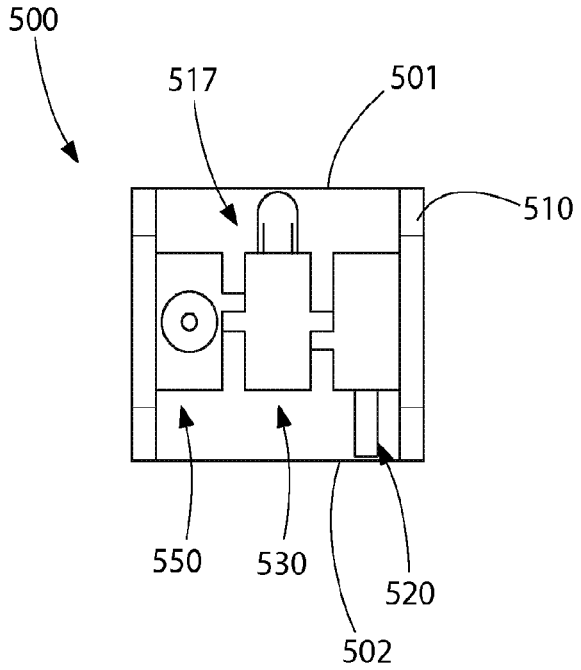
FIG. 5B is a top view of the oral care system of FIG. 5A.
Figure 5C:
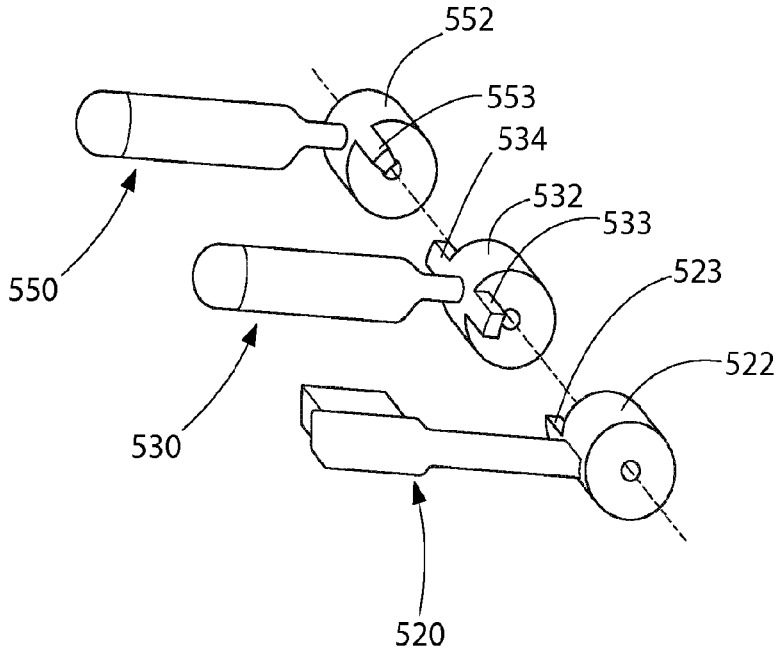
FIG. 5C is an illustration of the toothbrush and first and second dispensers of the oral care system of FIG. 5A.

Referring to FIGS. 5A-5C, an oral care system 500 will be described in accordance with an embodiment of the present invention. The oral care system 500 comprises a handle 510 having an internal cavity 517. The internal cavity 517 is a through slot extending from a first side 501 of the handle 510 to an opposing second side 502 of the handle 510. The through slot has an open top end 503 so that any of a toothbrush member 520, a first dispenser 520 or a second dispenser 550 can extend from the open top end 503 of the handle 510 for use thereof.

In the exemplified embodiment, the first dispenser 530 is in a first state such that the first dispenser 530 is located within the cavity 517. Similarly, the toothbrush member 520 is in a first state such that the toothbrush member 520 is located within the cavity 517. The second dispenser 550 is in a second state such that the second dispenser 550 extends from the open top end 503 of the handle 510. The oral care system 500 is designed so that as the second dispenser 550 is rotated from the second state into the first state (i.e., the second dispenser 550 is rotated from extending from the open top end 503 of the handle 510 to being positioned within the cavity 517), contact between the second dispenser 550 and one of the toothbrush member 520 or the first dispenser 520 forces the one of the toothbrush member 520 or the first dispenser 520 to rotate out of the first state so as to at least partially protrude from the through-slot. Upon protruding from the through-slot, a user can grip the one of the toothbrush member 520 or the first dispenser 520 and rotate it upwards until it is in the second state extending from the open top end 503 of the handle 510.

The same action can cause any of the components to cause any of the other components to protrude out of the cavity 517. Thus, when two of the first dispenser 530, the second dispenser 550 and the toothbrush member 520 are in the first state and the remaining one of the first dispenser 530, the second dispenser 550 and the toothbrush member 520 is being rotated from the second state into the first state, contact between the first dispenser, the second dispenser and the toothbrush member 530, 550, 520 forces one of the two of the first dispenser, the second dispenser and the toothbrush member 530, 550, 520 that are in the first state to rotate out of the first state and at least partially protrude from the through-slot (i.e., the protrude from one of the first and second ends 502, 503 of the handle 510.

FIG. 5C illustrates one possible technique for achieving the functionality of the oral care system 500. The toothbrush member 520 extends from a rotatable body 522, the first dispenser 530 extends from a rotatable body 532 and the second dispenser 550 extends from a rotatable body 552. In the exemplified embodiment, the first dispenser 530 is positioned in between the second dispenser 550 and the toothbrush member 520. A protrusion 523 extends outwardly from the rotatable body 522 of the toothbrush member 520. A protrusion 553 extends outwardly from the rotatable body 552 of the second dispenser 550. And first and second protrusions 533, 534 extend outwardly from the rotatable body 532 of the first dispenser 530. The protrusions are positioned so that upon rotation of one of the first dispenser, the second dispenser or the toothbrush member 530, 550, 520, the protrusions contact each other and cause another of the first dispenser, the second dispenser or the toothbrush member 530, 550, 520 to rotate out of the cavity 517 as has been described above.

The invention is not to be limited by the embodiment exemplified in FIG. 5C. Specifically, in other embodiments the bodies of the first and second dispensers and the toothbrush member 530, 550, 520 can be larger than their respective rotatable bodies 532, 552, 522 such that when the first and second dispensers and the toothbrush member 530, 550, 520 rotate, their bodies contact one another. As a result, when one of the first and second dispensers and the toothbrush member 530, 550, 520 rotates from the second state to the first state, the body of the one of the first and second dispensers and the toothbrush member 530, 550, 520 will contact the body of another one of the first and second dispensers and the toothbrush member 530, 550, 520 to cause the another one of the first and second dispensers and the toothbrush member 530, 550, 520 to rotate out of the first state positioned within the cavity 517 to at least partially protrude through the through-slot. In the exemplified embodiment, each of the toothbrush member, the first dispenser and the second dispenser 520, 530, 550 is independently rotatable about the same rotational axis.

Although the oral care system 500 is illustrated and described wherein it includes the first dispenser and the second dispenser 530, 550, in certain embodiments only a single dispenser can be used, or more than two dispensers can be used. Furthermore, the toothbrush member 520 can be omitted or substituted for any other type of oral care implement, or for another dispenser if desired. Furthermore, techniques other than those disclosed herein can be used to cause independent rotation of the toothbrush member, first dispenser and second dispenser 520, 530, 550 so that rotation of one of the components forces another one of the components out of the cavity 517 so as to protrude from the through-slot.

Finally, while in each of the embodiments illustrated herein the toothbrush member and dispenser(s) are rotatably coupled to the handle, in certain embodiments in which the oral care system comprises a toothbrush member and first and second dispensers, the first and second dispensers and/or the toothbrush member can be coupled to the handle in other manners. For example, other forms of coupling include, without limitation, snap-fit, slide-fit, tight-fit, slot-ridge mating, and other forms of coupling that allow for the first and/or second dispensers to be altered between a state in which the first and second dispensers are located within the cavity of the handle and a state in which the first and second dispensers extend from the handle (and cavity). In such embodiments, the toothbrush member can be fixedly coupled to the handle or coupled to the handle in any of the manner disclosed above for the first and/or second dispensers.

It should be appreciated that various combinations of the components and functionality described above with respect to the different embodiments are contemplated within the scope of the present invention. Therefore, certain features of one embodiment can be incorporated into another embodiment. Furthermore, certain features are not described in detail with regard to some of the embodiments with an understanding that the description of that similar feature in the other embodiments is equally applicable. Moreover, although the embodiments are described herein with a single dispenser or with two dispensers, other embodiments are contemplated that use more than two dispensers.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care system comprising:

a handle comprising a cavity and extending along a longitudinal axis from a proximal end to a distal end;

a toothbrush member comprising a first end rotatably coupled to the handle for rotation between: a first state in which the toothbrush member is positioned within the cavity; and a second state in which the toothbrush member extends from the distal end of the handle; and a first dispenser comprising a first store of oral care material, a cap, and a first end rotatably coupled to the handle for rotation between: a first state in which the first dispenser is positioned within the cavity; and a second state in which the first dispenser extends from the distal end of the handle;

wherein the first store of oral care material is a flowable liquid;

wherein the toothbrush member comprises a neck portion extending from the first end of the toothbrush member to a distal end, a head portion coupled to the distal end of the neck portion, the head portion being wider than the neck portion, and a transition region located between the distal end of the neck portion and the head portion, the transition region having a contoured shape; and wherein in the first state the first dispenser nests in the transition region of the toothbrush member further comprising a second dispenser comprising a second store of oral care material, a cap, and a first end rotatably coupled to the handle for rotation between: a first state in which the second dispenser is positioned within the cavity; and a second state in which the second dispenser extends from the distal end of the handle, and wherein the second store of oral care material is a flowable liquid; and wherein the toothbrush member is located between the first dispenser and the second dispenser, and wherein the caps of each of the first and second dispensers comprises a shape that corresponds with the contoured shape of the transition region of the toothbrush member so that each of the first and second dispensers nests within the transition region when in the first state; and wherein the toothbrush member and the first dispenser rotate about a same rotational axis.

2. The oral care system according to claim 1 wherein the toothbrush member and the first dispenser are rotatable independent of one another.

3. The oral care system according to claim 1 wherein the handle comprises a body portion and a lid coupled to the body portion to be adjustable between: an open state in which an access opening through which the toothbrush member and the first dispenser can pass into and out of the cavity is exposed; and a closed state in which the lid covers the access opening and encloses the cavity.

4. The oral care system according to claim 1 wherein the head portion of the toothbrush member has a front surface and a plurality of tooth cleaning elements extending from the front surface; wherein the toothbrush member rotates about a rotational axis; and wherein the front surface of the head portion is substantially perpendicular to the rotational axis.

5. The oral care system according to claim 1 wherein the cavity is a through slot extending from a first side of the handle to a second side of the handle, the through slot having an open top end; and wherein when the first dispenser is in the first state and the toothbrush member is being rotated from the second state into the first state, contact between the toothbrush member and the first dispenser forces the first dispenser to rotate out of the first state such that the first dispenser at least partially protrudes from the through-slot.

* * * * *